US005769408A

United States Patent [19]

Selak et al.

[11] Patent Number: 5,769,408

[45] Date of Patent: Jun. 23, 1998

[54] APPARATUS FOR FEEDING SHEETS

[75] Inventors: Martin M. Selak, Mt. Prospect; Vlado Radic, Park Ridge, both of Ill.

[73] Assignee: Astro Machine Corporation, Elk Grove Village, Ill.

[21] Appl. No.: 532,494

[22] Filed: Sep. 22, 1995

[51] Int. Cl.[6] ..... B65H 5/00

[52] U.S. Cl. ..... 271/10.03; 271/10.13; 271/116; 271/265.02

[58] Field of Search ..... 271/10.03, 10.11–10.13, 271/259, 116, 258.02, 265.02

[56] References Cited

U.S. PATENT DOCUMENTS

| | | | |
|---|---|---|---|
| 3,771,783 | 11/1973 | McInerny . | |
| 4,030,722 | 6/1977 | Irvine et al. | 271/10.13 |
| 4,085,673 | 4/1978 | Wierszewski . | |
| 4,365,889 | 12/1982 | Silverberg . | |
| 4,573,673 | 3/1986 | Haug | 271/10.03 |
| 4,607,833 | 8/1986 | Svyatsky et al. | 271/10.03 |
| 4,721,297 | 1/1988 | Katayama . | |
| 4,772,005 | 9/1988 | Hosking et al. . | |
| 4,819,927 | 4/1989 | Noguchi et al. | 271/10.03 |
| 4,986,523 | 1/1991 | Martin | 271/10.03 |
| 5,129,642 | 7/1992 | Svyatsky et al. | 271/10.03 |
| 5,133,396 | 7/1992 | Selak et al. . | |

*Primary Examiner*—Boris Milef
*Attorney, Agent, or Firm*—Wallenstein & Wagner, Ltd.

[57] ABSTRACT

A sheet feeder (10) has a plurality of feed rollers (A,B,C) driven by a drive shaft (62) contacting at least one sheet from a stack (S) of sheets and feeding that sheet downstream. Pull rollers (D) downstream of the feed rollers (A,B,C) driven by an intermediate shaft (84) feed the one sheet to an output location. A first sensor (130) in communication with the drive shaft (62) controls the drive shaft (62) between a driving condition and a non-driving condition. A second sensor (140) in communications with the intermediate shaft (84) controls the intermediate shaft (84) between a driving condition and a non-driving condition. In a driving condition, the drive shaft (62) drives the feed rollers (A,B,C) at a first radial speed and in a non-driving condition the feed rollers (A,B,C) free-wheel.

9 Claims, 3 Drawing Sheets

10
20
30
16
16
170
172
174
18
140
141
22
26
2
10b
12
M
R
A
66
100
67
R
B
14
78
79
124
R
C
82
104
14
R
44a
44b
44
44c
24
2

APPARATUS FOR FEEDING SHEETS

TECHNICAL FIELD

The present invention relates generally to sheet feeders and more particularly to a system for feeding a stack of sheets at a high rate of speed and preventing the sheets from bottlenecking or jamming in the sheet feeder. The sheet feeder includes a platform supporting a stack of sheets, feed rollers and downstream pull rollers, a first sensor and a second sensor. The first sensor detects the sheet and controls the on/off of the driving mechanism for the feed rollers. The second sensor detects the sheet and controls the on/off of the driving mechanism for the pull rollers.

BACKGROUND OF THE INVENTION

There are numerous uses and applications for sheet feeders. In many applications, a stack of sheets such as envelopes, papers, credit cards or business cards must be fed at a high rate of speed. Some sheet feeders use confronting rollers forming a nip that pull individual sheets from a stack and thus feed the sheets to an outlet position for manual or automatic removal. Often, such feeders are used as the front side of a fully automatic system, such as a laminator, labeler, sorter etc. To achieve an optimum feed rate, the individual sheets enter the nip as soon as the previous sheet exits the nip. Thus, the timing of the sheets being delivered to the nip can be critical. A problem encountered in trying to perfect such timing is the sheets are sometimes delivered too quickly to the nip and thus bottleneck at the nip. The bottleneck of sheets at the nip entry jams the sheet feeder requiring the sheets to be manually cleared from the nip. Another problem is feeders oftentimes are designed to accommodate sheets of only dimension ranges. The present invention is provided to overcome such problems; it can be used with uniform stacks of sheets of different widths, lengths and thicknesses; in addition, it is capable of feeding sheets at a high rate of speed, preventing bottlenecking or jamming in the sheet feeder.

SUMMARY OF THE INVENTION

The present invention solves these and other problems, and relates to a sheet feeder. According to a first aspect of the invention, the sheet feeder includes a platform that supports a stack of sheets. The feeder of the present invention has two primary sections. The first section includes feed rollers and the second section, downstream of the feed roller section, includes pull rollers. The feed roller section moves the sheets, one at a time, to the pull roller section. A first sensor detects the handoff of the sheet between the feed roller section and pull roller section. This first sensor turns off the driving mechanism of the feed roller section. The pull roller section, which includes a nip, receives the sheet and pulls it over the feed roller section unobstructedly to an output location. A second sensor detects when the sheet has reached the output location and stops the pull roller section from moving the sheet any further. Because the feed roller section is stopped from driving of the sheets, the sheets are not prematurely forced into the pull roller section. The casing for the feeder includes adjustment means for positioning sheets of different length and width on the platform. In addition, the pressure at the nip can be adjusted to accommodate sheets of different thicknesses. Moreover, adjustable sheet separators are positioned adjacent the platform forming a gap therebetween just upstream of the nip formed in the pull roller section to ensure only one sheet passes within the gap to the pull roller sections. The positioning of the second sensor is adjustable to change or vary the output location. In this manner, a sheet can be fed and the leading edge thereof stopped and held by the pull roller at numerous points, such as one-half inch, one inch, two inches, etc., downstream of the nip. Held in the desired location, the sheet can be removed from the nip manually or automatically. Or, the second sensor can be positioned to allow the pull roller section to release, or kick, the fed sheet out, or downstream, of the nip rollers into, for example, a collection bin or onto a conveyor belt, permitting further work on the sheet. To prevent the feed roller section from locking up, one-way bearings are employed to permit the rollers to free-wheel. In this manner, the sheet being pulled by the pull roller section passes unobstructively over the feed roller section. Clutches are also employed to stop mechanisms from being driven. Once the sheet clears the feed roller section, the sensor activates the feed roller section to drive another sheet downstream to the pull roller section.

In particular, the sheet feeder has a plurality of feed rollers connected to a first drive means and adapted for contacting the one sheet from the stack of sheets and feeding that sheet downstream. One or more pull rollers are positioned downstream of the feed rollers and are connected to a second drive means and adapted for contacting the one sheet fed from the feed rollers and feeding the one sheet to an output location. A first sensor disposed downstream of the feed rollers detects either the presence or the absence of the one sheet and is in communication with the first drive means. The first sensor controls the first drive means to either a driving condition or a non-driving condition. The driving condition of the first drive means occurs when the absence of the one sheet is detected by the first sensor and the non-driving condition occurs when the presence of the one sheet is detected by the first sensor. A second sensor disposed downstream of the pull rollers also detects either the presence or absence of the one sheet and is in communication with the second drive means. The second sensor controls the second drive means to either a driving condition or a non-driving condition. As with the first drive means, the driving condition of the second drive means occurs when the absence of the one sheet is detected by the second sensor and the non-driving condition of the second drive means occurs when the presence of the one sheet is detected by the second sensor. In a driving condition, the first drive means drives the feed rollers at a first radial speed and in a non-driving condition, the feed rollers can free-wheel.

According to a another aspect of the invention, the sheet feeder includes a pair of drive means. A first drive means includes a motor driving a motor shaft connected to a motor sprocket. The motor sprocket is entrained with and drives a first drive sprocket connected to a drive shaft. A first shaft supporting a first feed roller is connected to at least two first shaft sprockets. One of the first shaft sprockets is entrained with and is driven by a second drive sprocket connected to the drive shaft. A second shaft supporting a second feed roller is connected to at least two second shaft sprockets, one second shaft sprocket is entrained with and is driven by the other first shaft sprocket. A third shaft supporting a third feed roller is connected to at least one third shaft sprocket. The third shaft sprocket is entrained with and is driven by the other second shaft sprocket.

A second drive means includes an intermediate shaft and first and second intermediate sprockets. A third drive sprocket is connected to the drive shaft and is entrained with and drives the first intermediate sprocket. A pull roller shaft supporting at least the pull roller is connected to at least one pull roller shaft sprocket. The pull roller shaft sprocket is entrained with and is driven by the second intermediate sprocket.

According to a further aspect of the invention, a single feed roller can be used in conjunction with the pull roller in the sheet feeder.

According to yet another aspect of the invention, the first, second and third shafts are each supported by a conventional one-way bearing permitting a rigid connection between the first, second and third shafts and associated feed rollers with the one first shaft sprocket, the one second shaft sprocket and the third shaft sprocket when the first, second and third feed rollers are rotating at the first radial speed and a free-wheeling connection between the first, second and third shafts and associated pairs of feed rollers with the one first shaft sprocket, the one second shaft sprocket and the third shaft sprocket when the first, second and third rollers are in a non-driving condition.

Thus, instead of locking when the first drive means is not driving the first, second and third shafts, the shafts are free to rotate when the travelling pulled sheet is pulled over the first, second and third rollers at speeds (radial) greater than the driven speeds (driving condition) or when the shafts are not being driven (non-driving condition).

Other advantages and aspects of the present invention will become apparent upon reading the following description of the drawings and detailed description of the invention.

BRIEF DESCRIPTION OF THE DRAWINGS

In order that the present invention may be more fully understood, it will now be described by way of example, with reference to the accompanying drawings in which.

DETAILED DESCRIPTION OF THE INVENTION

Figure 1:
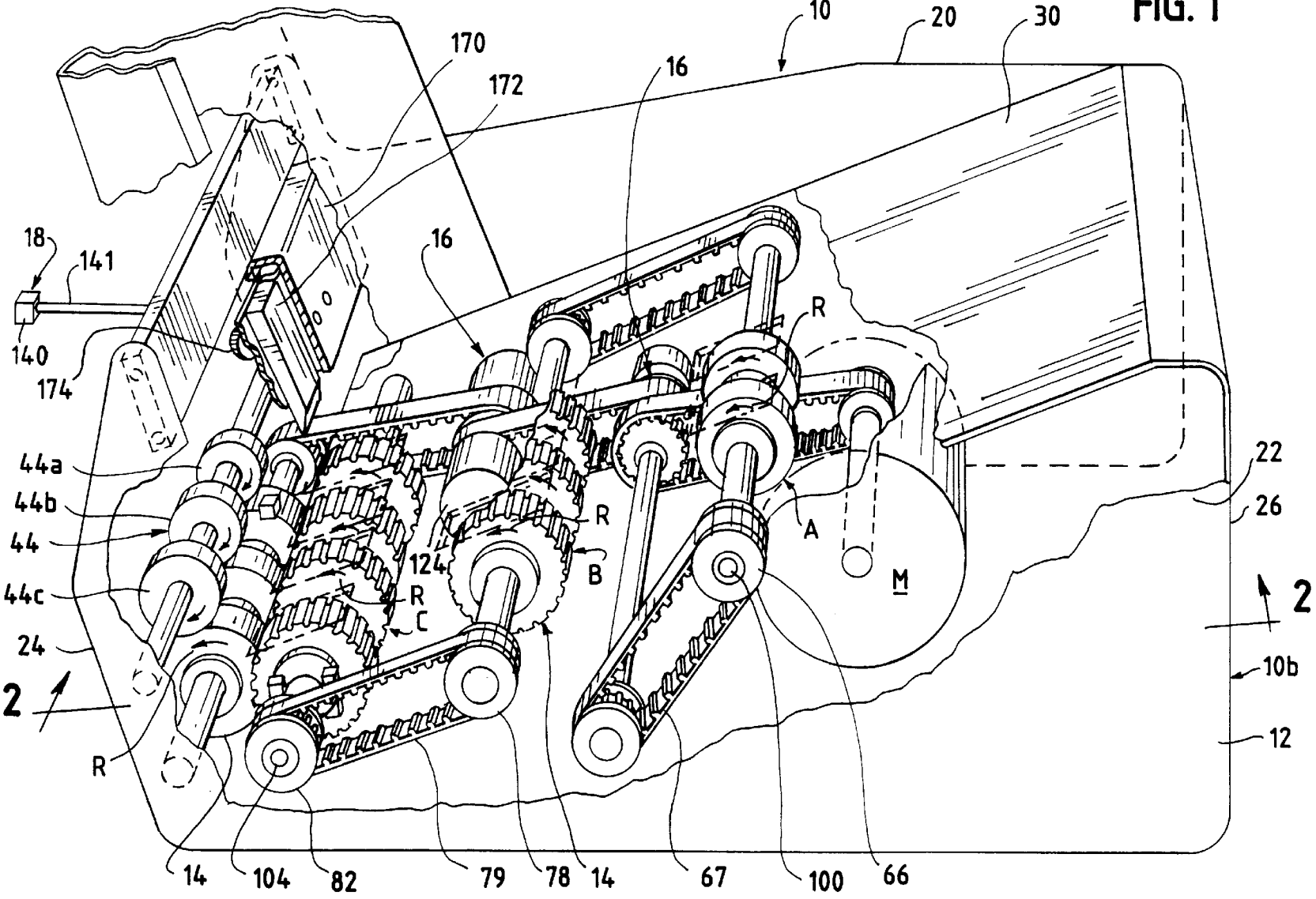
FIG. 1 is a perspective view of the sheet feeder of the present invention with a portion of the casing removed to show the feed rollers, the pull rollers and the associated drive mechanisms.

While this invention is susceptible of embodiment in many different forms, there is shown in the drawings and will herein be described in detail, some preferred embodiments of the invention with the understanding that the present disclosure is to be considered as an exemplification of the principles of the invention and is not intended to limit the broad aspect of the invention to the embodiments illustrated.

Referring to the drawings, FIG. 1 shows a sheet feeder 10 of the present invention. The structure of the sheet feeder 10 will first be described followed by the operation of the sheet feeder 10.

Structure of the Sheet Feeder

The sheet feeder 10 is generally comprised of a support structure 12, or casing, two sets of rollers 14, a pair of drive means 16 and a pair of sensors 18.

The support structure 12 of the sheet feeder 10 includes opposed side walls 20,22 connected at their outer ends by a front wall 24 and a rear wall 26. A bottom wall 28 confronts lower edges of the opposed side walls, 20,22 front wall 24 and rear wall 26, thus forming a box-like casing having an open-top. A platform 30 having a substantially flat upper surface 31 is positioned between the opposed side walls 20,22 and spaced below upper surfaces of the side walls 20,22. The platform 30 supports a stack of sheets S to be fed by the sheet feeder 10. The platform 30 has openings (not shown) to accommodate a peripheral portion of feed rollers which will be described below. In its preferred form, the platform 30 is inclined downwardly from a rear end 10*b* of the sheet feeder 10 to a front end 10*a* of the sheet feeder 10. In such an inclined configuration, leading edges of the sheets in the stack S abut a bumper 32 positioned proximate the front end 10*a* of the sheet feeder 10. Also, the platform 30 may have an arcuate raised front edge 33 to assist the sheets being fed to a downstream position. The front wall 24 of the sheet feeder 10 has a narrow horizontal opening 24*a* adjacent the platform 30 to allow sheets to be fed therethrough. Generally, the stack of sheets S fit closely within the opposed side walls 20,22 which assist the sheets being fed in a straight path. Laterally adjustable guides (not shown) can also be provided on the platform to accommodate a stack of sheets having a width less than the width of the opposed side walls 20,22.

Figure 2:
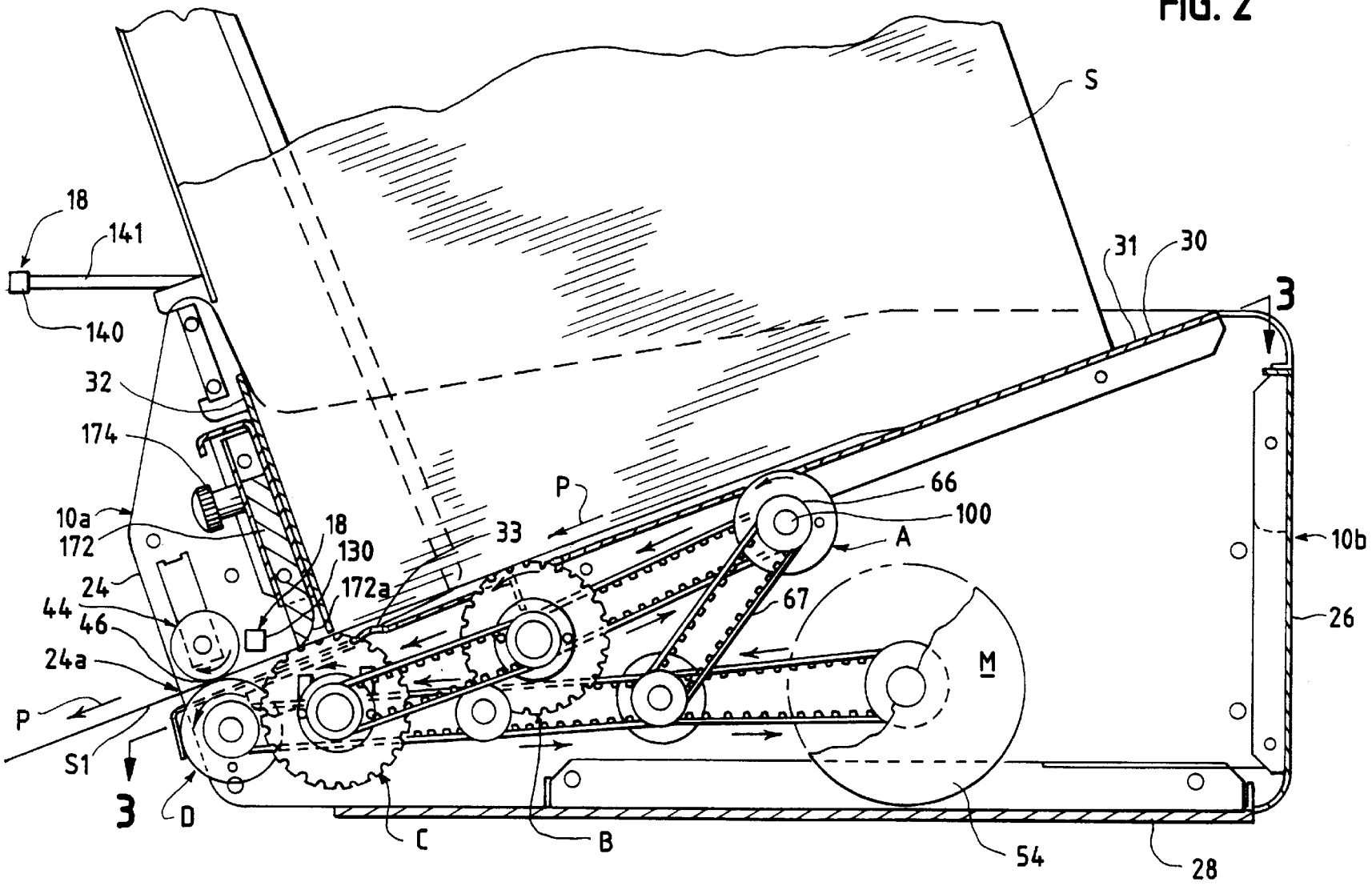
FIG. 2 is a sectional side elevation view of the sheet feeder along line 2—2 in FIG. 1; and, FIG. 3 is a sectional top plan view of the sheet feeder along line 3—3 of FIG. 2 showing the feed rollers, pull rollers and associated drive mechanisms.
Figure 3:
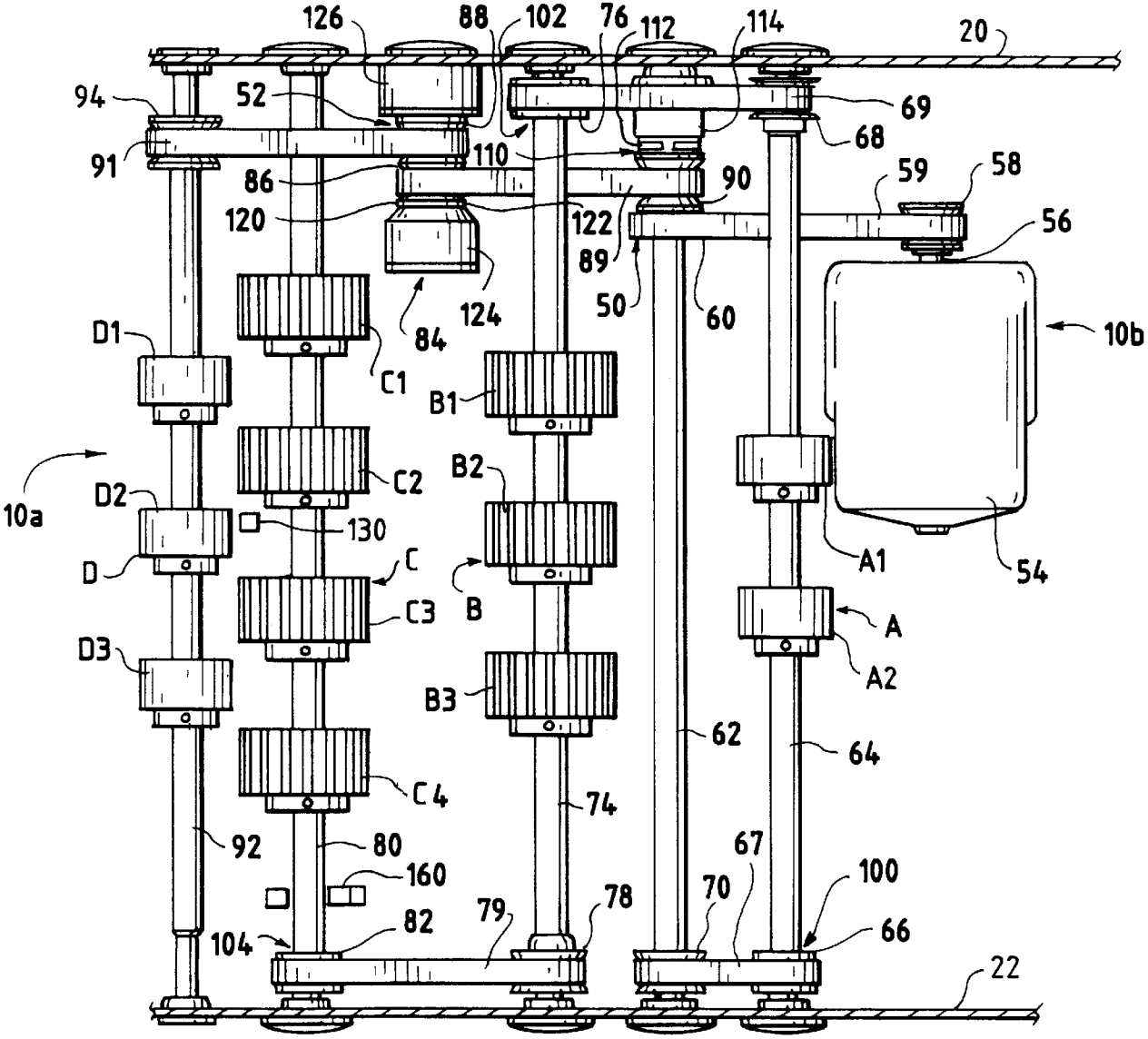

As shown in FIGS. 2 and 3, the sheet feeder 10 utilizes two sets of rollers 14 to feed the sheets, namely, feed rollers and pull rollers. Also, the sheet feeder 10 can use either a single feed roller, or first roller, or a plurality of feed rollers.

As shown in FIG. 3, the sheet feeder 10 uses three individual or sets of feed rollers to feed or move individual sheets downstream: a first feed roller A, a second feed roller B and a third feed roller C. The first feed roller A is positioned towards the rear end 10*b* of the sheet feeder 10. As just noted, the individual rollers may be sets of rollers to facilitate movement of the sheets. As shown in the Figures, the first feed roller A includes two individual spaced, parallel rollers A1 and A2. The second feed roller B is positioned downstream of roller A towards the front end 10*a* of the sheet feeder 10. The second feed roller B includes three individual spaced parallel rollers B1,B2,B3. The third feed roller C is positioned downstream of the second feed roller B. In the embodiment shown, the third feed roller C includes four individual spaced rollers C1,C2,C3,C4. The number of individual spaced rollers used can, of course, vary depending on the width of the sheets being stacked or the needs and requirements of the system. In addition, the feed rollers may comprise a single roller extending across the width of the sheet feeder 10.

The sheet feeder 10 also uses a pull roller D. The pull roller D is positioned at the front end 10*a* of the sheet feeder 10. In the described and shown embodiment, the pull roller D includes three individual spaced parallel rollers D1,D2, D3. As shown in FIGS. 1 and 2, an adjustable roller 44 confronts the pull roller D resulting in a nip 46 formed therebetween. The adjustable roller 44 adjusts according to the thickness of the sheets being fed. The adjustable roller 44 includes three individual spaced rollers 44*a*,44*b*,44*c* that confront the three individual spaced rollers D1,D2,D3 of the pull roller D. The nip 46 is aligned with the horizontal opening 24*a* of the front wall and pulls sheets through the sheet feeder 10 as will be described below.

The sheet feeder 10 has a pair of drive means 16 to drive the feed rollers A,B,C and the pull roller D. A first drive means 50 drives the feed rollers A,B,C and a second drive means 52 drives the pull roller D.

As shown in FIG. 3, the first drive means 50 includes a motor 54 driving a motor shaft 56 connected to a motor sprocket 58. A first drive sprocket 60 is connected to a drive shaft 62. The drive shaft 62 extends between the opposed side walls 20,22 and is supported for rotation therein. The motor sprocket 58 is entrained with and drives the first drive sprocket 60 by a chain 59. All of the entraining is accomplished using serrated belts and cooperating, serrated rollers. This combination acts as a chain-sprocket combination and such components will hereinafter be referred to as chains and sprockets.

A first shaft 64 supporting the first feed roller A is connected to at least two first shaft sprockets 66,68. The first shaft 64 extends between the opposed side walls 20,22 and is supported for rotation therein. A second drive sprocket 70 is connected to the drive shaft 62. One of the first shaft sprockets 66 is entrained with and is driven by a second drive sprocket 70 by a chain 67. A second shaft 74 supporting the second feed roller B is connected to at least two second shaft sprockets 76,78. The second shaft 74 extends between the opposed side walls 20,22 and is supported for rotation therein. One of the second shaft sprockets 76 is entrained with and is driven by the other first shaft sprocket 68 by a chain 69. A third shaft 80 supporting the third feed roller C is connected to at least one third shaft sprocket 82. The third shaft 80 extends between the opposed side walls 20,22 and is supported for rotation therein. The third shaft sprocket 82 is entrained with and is driven by the other second shaft sprocket 78 by a chain 79. Also shown in FIG. 3, the third shaft 80 has a friction brake 160 mounted thereon. The friction brake is cantilevered to bias the roller C to prevent rotation of roller C by inertia or momentum. This will be described in greater detail below.

The second drive means 52 drives the pull roller D. The second drive means includes an intermediate shaft 84 and first and second intermediate sprockets 86,88 mounted thereon. A third drive sprocket 90 is connected to the drive shaft 62. The third drive sprocket 90 is entrained with and drives the first intermediate sprocket 86 by a chain 89. A pull roller shaft 92 supporting at least the pull roller D is connected to at least one pull roller shaft sprocket 94. The pull roller shaft 92 extends between the opposed side walls 20,22 and is supported for rotation therein. The pull roller shaft sprocket 94 is entrained with and is driven by the second intermediate sprocket 88 by a chain 91.

A first one-way bearing 100 is disposed between one of the first shaft sprockets 66 and the first shaft 64. A second one-way bearing 102 is disposed between one of the second drive sprockets 76 and the second shaft 74. A third one-way bearing 104 is disposed between the third shaft sprocket 82 and the third shaft 80. The one-way bearings are conventional one-way bearings and are available, for example, from the Torrington Company. The one-way bearings permit rotation in one direction and prohibit rotation in the other direction. In the desired direction of rotation as shown by the arrows R in FIG. 1, the one-way bearings 100,102,104 thus provide a rigid connection between the first, second and third shafts 64,74,80 and associated first, second and third feed rollers A,B,C respectively. Thus, under certain circumstances, the first one-way bearing 100 provides a rigid connection between the first shaft 64 and the first shaft sprocket 66 to rotate the first feed roller A; the second one-way bearing 102 provides a rigid connection between the second shaft 74 and the second shaft sprocket 76 to rotate the second feed roller B; and the third one-way bearing 104 provides a rigid connection between the third shaft 80 and the third shaft sprocket 82 to rotate the third feed roller C.

Thus, when the first drive means 50 is in the driving condition, the motor 54 is driving the drive shaft 62 at a first radial speed. Drive shaft 62 drives the first, second and third shafts 64,74,80 which rotate the feed rollers A,B,C. When the drive means 50 is not in a driving condition, such that the shafts 64,74,80 are not being driven, the one-way bearings 100,102,104 permit and allow the first shaft 64, second shaft 74 and the third shaft 80 to free wheel thus resulting in the feed rollers A,B,C respectively to rotate freely in the direction R (FIG. 1). In addition, if the feed rollers A,B,C are rotated at a radial speed greater than the first radial speed from the drive shaft 62 (e.g. a sheet pulled over the feed rollers at a speed greater than the first radial speed), the one-way bearings 100,102,104 will allow the shafts 64,74,80 and thus the feed rollers A,B,C to free-wheel.

A pair of sensors 18 are incorporated into the sheet feeder 10. The sensors are conventional optical reflective sensors and can be mounted on the support structure 12 in a number of conventional fashions. As schematically shown in FIG. 2, a first sensor 130 is positioned between the feed roller C and the pull roller D. The first sensor 130 controls the first drive means 50 between a driving condition and a non-driving condition by detecting the presence and absence of the sheet being fed. The driving condition is when the first sensor 130 detects the absence of the sheet and the non-driving condition is when the first sensor 130 detects the presence of the sheet.

A second sensor 140 is positioned downstream of the pull roller D. As shown in FIG. 2, the second sensor 140 is preferably mounted on a gooseneck 141 connected to the front wall 24 of the sheet feeder 10. The gooseneck 141 can be linearly adjustable to vary the downstream position of the second sensor 140 from the pull roller D. The second sensor 140 controls the second drive means 52 between a driving condition and a non-driving condition by detecting the presence and absence of the sheet being fed. The driving condition is when the second sensor 140 detects the absence of the sheet and the non-driving condition is when the second sensor 140 detect the presence of the sheet.

The sheet feeder 10 also uses clutch mechanisms with the drive shaft 62 and intermediate shaft 84. A first clutch mechanism 110 is connected to the drive shaft 62. The clutch mechanism 110 includes a clutch 112 and a clutch control 114. The first sensor 130 communicates with the clutch control 114 to control the clutch 112. The clutch 112 controls the rotation of the second drive sprocket 70 from a rotating condition to a non-rotating condition. When the second drive sprocket 70 is in a rotating condition, the first shaft 64, second shaft 74 and third shaft 80 are driven thereby, thus rotating the feed rollers A,B,C. When the second drive sprocket 70 is in a non-rotating condition, the first shaft 64, second shaft 74 and third shaft 80 are not driven thereby.

A second clutch mechanism 120 is connected to the intermediate shaft 84. The second clutch mechanism 120 includes a clutch 122 and a clutch control 124. The second sensor 140 communicates with the clutch control 124 to control the clutch 122. The clutch 122 controls the rotation of the second intermediate sprocket 88 from a rotating condition to non-rotating condition. When the second intermediate sprocket 88 is in a rotating condition, the pull roller shaft 92 is driven thereby, thus rotating the pull roller D. When the second intermediate sprocket 88 is in a non-rotating condition, the pull roller shaft 92 is not driven thereby. A brake 126 is also mounted on the intermediate shaft. The second sensor 140 also communicates with the brake 126 to immediately stop rotation of the second intermediate sprocket 88 when the intermediate drive sprocket 88 is placed in a non-driving position.

As shown in FIG. 1, a bar 170 is mounted between the opposed side walls 20,22 above the feed roller C. Sheet separators 172 are supported in tracks (not shown) in the bar 170 and are positioned over the individual spaced rollers C1,C2,C3,C4 of the feed roller C. The sheet separators 172 are vertically adjustable by tightening knob 174 according to the thickness of the sheets being fed. The sheet separators 172 are positioned to allow only a single sheet to be fed to the pull roller D. The sheet separators 172 have an arcuate front face 172a to assist in the sheets passing under the sheet separators.

Operation of the Sheet feeder 10

The sheet feeder 10 described above feeds sheets rapidly and continuously, one at a time, along a path P (FIG. 2) to an output location. The output location can include further processing apparatus (not shown). The sheet feeder 10 also prevents the sheets being fed from bottlenecking or jamming at the nip 46 of the sheet feeder 10.

First, the stack of sheets S is positioned on the platform 30. Leading edges of the sheets abut the bumper 32. The sheet separators 172 are vertically adjusted using the tightening knob 174 according to the thickness of the sheets being fed the allow only one sheet to be fed to the pull roller D. The feed rollers protrude through the openings in the platform to contact a first sheet Si of the stack S.

To commence feeding, the first and second drive means 50,52 must be put into a driving condition from a non-driving condition. The second drive sprocket 70 on the drive shaft 62 and the second intermediate sprocket 88 on the intermediate shaft 84 are initially in a non-rotating condition, i.e. the clutch mechanisms 110, 120 are not engaged. The motor 54 is first energized to drive the first drive sprocket 60 and the first intermediate sprocket 86 via the third drive sprocket 90. It will be appreciated that the first drive sprocket 60 and the first intermediate sprocket 86 are always driven when the motor 54 is energized regardless of the positions of the clutch mechanisms 110,120. The clutch mechanisms 110,120 control when the first, second, third and pull roller shafts 64,74,80,92 are driven.

With the motor 54 energized, the sheet feeding can begin. Because the first and second sensors 130,140 have not yet detected the presence of a first sheet S1, a manual start (not shown) can be provided to initiate the driving of the first, second and third shafts 64,74,80 to rotate the feed rollers A,B,C and feed the first sheet S1. The pull roller shaft 92 is also driven to rotate the pull roller D. Once the first sheet Si is fed, the sensors 130,140 then control the feeding. An automatic start can also be programmed into the sheet feeder 10 if desired.

When the feeding is commenced through manual or automatic control, the first clutch mechanism 110 engages the drive shaft 62 to drive the second drive sprocket 70. The drive sprocket 70 on drive shaft 62 thus drives the first shaft 64 which, in turn, drives the second shaft 74 which, in turn, drives the third shaft 80. The shafts 64,74,80 then rotate the feed rollers A,B,C in the radial direction R (Fig.1) to feed the first sheet downstream to the pull roller D along the path P. The second clutch mechanism 120 engages the intermediate shaft 84 to drive the second intermediate sprocket 88 which drives the pull roller shaft 92. The pull roller shaft 92 then rotates the pull roller D in the radial direction R (FIG. 1) to pull the first sheet Si fed from the feed rollers A,B,C.

As the feed rollers A,B,C are in contact with the first sheet S1, the first sheet S1 is fed downstream to the pull roller D. The sensor 130, positioned downstream of the feed roller C, detects the presence of the first sheet S1 and then communicates with the first clutch mechanism 110. The first clutch mechanism 110 disengages the clutch 112 so that the drive shaft 62 stops driving the second drive sprocket 70. This places the second drive sprocket 70 into a non-rotating condition which then stops driving the first, second and third shafts 64,74,80. The feed rollers A,B,C stop being rotated by the shafts 64,74,80.

It will be appreciated that due to the position of the first sensor 130, the first, second and third shafts 64,74,80 are only driven a short period of time. Thus, the feed rollers A,B,C "burst" or shoot the first sheet S1 to the pull roller D. Thus, once the feed rollers A,B,C stop being rotating through the drive shaft 62, the first sheet S1 has been fed to the nip 46 to be pulled by the pull roller D.

The pull roller D is rotated by the pull roller shaft 92 which is driven by the second intermediate sprocket 88. In conjunction with the adjustable roller 44, the first sheet S1 is pulled into the nip 46 to feed the sheet to the output location. The pull roller D pulls the first sheet S1 over the feed rollers A,B,C. Although the first, second and third shafts 64,74,80 are no longer being driven by the first drive means 50, the one-way bearings 100,102,104 permit the first, second and third shafts 64,74,80 to rotate as the first sheet Si contacts and is pulled over the feed rollers A,B,C by the pull roller D. Thus, the first sheet S1 causes the feed rollers A,B,C to rotate. Specifically, the first one-way bearing 100 permits the shaft 64 and therefore, the first feed roller A to rotate. The second one-way bearing 102 permits the second shaft 74 and therefore, the second feed roller B to rotate. The third one-way bearing 104 permits the third shaft 80 and, therefore the third feed roller C to rotate. This configuration assists in the speed at which the first sheet S1 can be pulled by the pull roller D.

Each of the feed rollers A,B,C stops rotating, however, at the instant the first sheet S1 is pulled passed and loses contact with each of the feed rollers A,B,C. Thus, as the first sheet S1 is pulled passed the feed roller A, the feed roller A immediately stops rotating. Likewise, as the first sheet S1 is pulled passed the feed rollers B and C, the feed rollers B and C immediately stop rotating. Because the feed roller C is positioned adjacent the pull roller D, the brake 160 is provided to stop inertial rotation or momentum of the feed roller C as the first sheet is pulled passed the feed roller C. The next sheet in the stack S which then contacts the feed rollers A,B,C, is not prematurely fed towards the pull roller D. Thus, the sheets do not bottleneck or jam in the sheet feeder 10.

As the first sheet S1 is pulled further through the nip 46 by the pull roller D, the second sensor 140 detects the presence of the first sheet S1. Upon detecting the presence of the first sheet S1, the second sensor 140 communicates with the second clutch mechanism 120 and the brake 126. The second clutch mechanism 120 disengages the clutch 122 so that the intermediate shaft 84 stops driving the second intermediate sprocket 88. This places the second intermediate sprocket 88 into a non-rotating condition which then stops driving the pull roller shaft 92. The pull roller D is thus stopped from being rotated by the pull roller shaft 92. The brake 126 is also engaged to immediately stop the rotation of the pull roller shaft 92 and the pull roller D. This abruptly stops the first sheet S1.

The first sheet S1 can then be removed or pulled from the nip 46 into downstream equipment (not shown) for further processing. For example, another set of rollers can pull the first sheet S1 to additional equipment. The adjustable roller 44 is vertically adjusted to vary the force required to pull the first sheet S1 from nip 46. In addition, the second sensor 140 can, of course, be positioned further downstream so that the pull roller D pulls the first sheet S1 completely through the nip 46.

When the first sheet S1 is pulled through the nip 46 and removed, the first sheet S1 is pulled passed the first sensor 130. The first sensor 130 detects the absence of the sheet and then communicates with the first clutch mechanism 110 to return the second drive sprocket 70 to a rotating condition. The clutch 112 engages the drive shaft 62 for the second drive sprocket 70 to drive the first shaft 64, and hence the second shaft 74 and the third shaft 80. This will rotate the feed rollers A,B,C and commence feeding the next sheet in the stack downstream to the pull roller D.

As the first sheet S1 is pulled passed the second sensor 140, the second sensor 140 detects the absence of the sheet and then communicates with the second clutch mechanism 120 to return the second intermediate sprocket 88 to a rotating condition. The clutch 122 engages the intermediate shaft 84 for the second intermediate sprocket 88 to drive the pull roller shaft 92. This will rotate the pull roller D to pull the next sheet being fed by the feed rollers A,B,C. The process is repeated for the entire stack of sheets or the sheet feeder 10 can be programmed to feed a certain number of sheets, etc.

By positioning the first sensor 130 upstream of the second sensor 140, the first sensor 140 will communicate with first clutch mechanism 110 to stop the driving of the first, second and third shafts 64,74,80 which will stop the feeding of the sheet in contact therewith. The one-way bearings 100,102, 104 will permit the feed rollers A,B,C to free-wheel, permitting the pull roller D in combination with the adjustable roller 44 to pull the sheets over the feed rollers A,B,C. Once the sheet loses contact with the feed rollers A,B,C, however, the feed rollers A,B,C will immediately stop rotating. This will prevent these upstream feed rollers A,B,C from forcing the next sheets in the stack downstream to the pull roller D or prematurely feeding the sheets to the pull roller D. In sum, the sheets will not bottleneck or jam in the sheet feeder 10, specifically at the nip 46.

Such arrangement also permits a lot of sheets, resulting in a lot of weight, to be fed through the sheet feeder 10. It is appreciated that the above structure permits the feeding process to be extremely rapid because of the positioning of the sensors and the free-wheeling capability of the feed rollers A,B,C. The above described sheet feeder 10 can feed up to 35,000 sheets per hour.

Also, a variety of sheets can be fed such as envelopes, business cards, labels, name tags and credit cards. With the spacing of the feed rollers A,B,C, sheets of different lengths can be accommodated in a single sheet feeder 10. For example, a stack of envelopes may contact all feed rollers A, B and C while a stack of business cards may only contact feed rollers B and C.

The sheet feeder 10 can also include computer controls and be programmed according to individual needs. For example, the sheet feeder 10 may optionally be programmed to feed a sheet every other second or a predetermined number of sheets upon receiving an external command. An additional sensor can also be included with the sheet feeder 10 to detect the unlikely event of a misfeed or double-feed and shut down the sheet feeder 10. Finally, it will be appreciated that the positioning of the first and second sensors 130,140 can be varied according to individual requirements.

While the invention has been described with reference to some preferred embodiments of the invention, it will be understood by those skilled in the art that various modifications may be made and equivalents may be substituted for elements thereof without departing from the broader aspects of the invention. The present examples and embodiments, therefore, are illustrative and should not be limited to such details.

We claim:

1. A sheet feeder comprising:

a platform for supporting a stack of sheets;

a first roller adapted for contacting at least one sheet from the stack of sheets and feeding the sheet downstream, the first roller including at least first, second and third feed rollers with each feed roller being connected to a first drive means, the first drive means connected to and for driving the first roller, the first drive means including:

a motor driving a motor shaft connected to a motor sprocket, the motor sprocket being entrained with and driving a first drive sprocket connected to a drive shaft having a second drive sprocket;

a first shaft supporting the first feed roller connected to at least two first shaft sprockets, one first shaft sprocket entrained with and being driven by the second drive sprocket;

a second shaft supporting the second feed roller connected to at least two second shaft sprockets, one second shaft sprocket entrained with and being driven by the other first shaft sprocket; and, a third shaft supporting the third feed roller connected to at least one third shaft sprocket, the third shaft sprocket entrained with and being driven by the other second shaft sprocket;

the second roller being positioned downstream of the first roller and adapted for contacting at least the one sheet fed from the first roller and feeding the one sheet to an output location, the second roller including at least one pair of parallel pull rollers connected to a second drive means;

the second drive means connected to and for driving the second roller;

a first sensor means disposed downstream of the first roller for detecting either the presence or absence of the one sheet and communicating with the first drive means;

the first sensor means controlling the first drive means to change from a driving condition to a non-driving condition when the presence of the one sheet is detected by the first sensor means and to change from a non-driving condition to a driving condition when the absence of the one sheet is detected by the first sensor means;

a second sensor means disposed downstream of the second roller for detecting either the presence or absence of the one sheet and communicating with the second drive means;

the second sensor means controlling the second drive means to change from a driving condition to a non-driving condition when the presence of the one sheet is detected by the second sensor means and to change from a non-driving condition to a driving condition when the absence of the one sheet is detected by the second sensor means;

in a driving condition the first drive means driving the first roller at a first radial speed in a first radial direction, and in a non-driving condition the first drive means not driving the first roller, in a driving condition the second drive means driving the second roller at a second radial speed; and, a means associated with the first roller for permitting the first roller to free-wheel in the first radial direction either when the first drive means is not driving the first roller or when the radial speed of the first roller is greater than the first radial speed.

2. The sheet feeder of claim 1 wherein the first roller free-wheels at a radial speed corresponding to the radial speed of the second roller.

3. The sheet feeder of claim 1 wherein the second roller is in communication with an adjustable roller resulting in a nip formed therebetween.

4. The sheet feeder of claim 1 wherein the second drive means includes:

an intermediate shaft and first and second intermediate sprockets, a third drive sprocket connected to the drive shaft and being entrained with and driving the first intermediate sprocket; and, a second roller shaft supporting at least the second roller connected to at least one second roller shaft sprocket, the second roller shaft sprocket entrained with and being driven by the second intermediate sprocket.

5. The sheet feeder of claim 4 wherein the drive shaft and the intermediate shaft are each connected to a clutch mechanism, the clutch mechanism connected to the drive shaft communicating with the first sensor means and controlling the rotation of the second drive sprocket from a rotating condition to a non-rotating condition, when the second drive sprocket is in a rotating condition, the first, second and third shafts are driven thereby and when the second drive sprocket is in a non-rotating condition, the first, second and third shafts are not rotating, the clutch mechanism connected to the intermediate shaft communicating with the second sensor means and controlling the rotation of the second intermediate sprocket from a rotating condition to a non-rotating condition, when the second intermediate sprocket is in a rotating condition, the second roller shaft is driven thereby and when the second intermediate sprocket is in a non-rotating condition, the second roller shaft is not rotating.

6. A sheet feeder comprising:

a platform for supporting a stack of sheets;

at least three feed rollers adapted for contacting at least one sheet from the stack of sheets and feeding the sheet downstream;

a first drive means connected to and for driving the feed rollers, each feed roller being connected to the first drive means, the first drive means including:

a motor driving a motor shaft connected to a motor sprocket, the motor sprocket being entrained with and driving a first drive sprocket connected to a drive shaft;

a first shaft supporting a first one of said feed rollers connected to at least two first shaft sprockets, one first shaft sprocket entrained with and being driven by a second drive sprocket connected to the drive shaft;

a second shaft supporting a second one of said feed rollers connected to at least two second shaft sprockets, one second shaft sprocket entrained with and being driven by the other first shaft sprocket; and, a third shaft supporting a third one of said feed rollers connected to at least one third shaft sprocket, the third shaft sprocket entrained with and being driven by the other second shaft sprocket;

a pull roller positioned downstream of the feed rollers adapted for contacting at least the one sheet fed from the feed rollers, in communication with an adjustable roller resulting in a nip formed therebetween, and feeding the one sheet to an output location;

a second drive means connected to and for driving the pull roller;

a first sensor disposed downstream of the feed rollers for detecting either the presence or the absence of the one sheet and communicating with the first drive means;

the first sensor controlling the first drive means between a driving condition and a non-driving condition, the driving condition being when the absence of the one sheet is detected by the first sensor and the non-driving condition being when the presence of the one sheet is detected by the first sensor; and, a second sensor disposed downstream of the pull roller for detecting either the presence or absence of the one sheet and communicating with the second drive means;

the second sensor controlling the second drive means between a driving condition and a non-driving condition, the driving condition being when the absence of the one sheet is detected by the second sensor and the non-driving condition being when the presence of the one sheet is detected by the second sensor;

in a driving condition the first drive means driving the feed rollers at a first radial speed in a first radial direction, and in a non-driving condition the first drive means not driving the feed rollers;

in a driving condition the second drive means driving the pull roller at a second radial speed; and, a means associated with the feed rollers for permitting the feed rollers to free-wheel in the first radial direction either when the first drive means is not driving the feed rollers or when the radial speed of the feed rollers is greater than the first radial speed.

7. The sheet feeder of claim 6 wherein the second drive means includes:

an intermediate shaft and first and second intermediate sprockets, a third drive sprocket connected to the drive shaft being entrained with and driving the first intermediate sprocket; and, a pull roller shaft supporting at least the pull roller connected to at least one pull roller shaft sprocket, the pull roller shaft sprocket entrained with and being driven by the second intermediate sprocket.

8. The sheet feeder of claim 7 wherein the drive shaft and the intermediate shaft are each connected to a clutch mechanism, the clutch mechanism connected to the drive shaft communicating with the first sensor and controlling the rotation of the second drive sprocket from a rotating condition to a non-rotating condition, when the second drive sprocket is in a rotating condition, the first, second and third shafts are driven thereby and when the second drive sprocket is in a non-rotating condition, the first, second and third shafts are not rotating, the clutch mechanism connected to the intermediate shaft communicating with the second sensor and controlling the rotation of the second intermediate sprocket from a rotating condition to a non-rotating condition, when the second intermediate sprocket is in a rotating condition, the pull roller shaft is driven thereby and when the second intermediate sprocket is in a non-rotating condition, the pull roller shaft is not rotating.

9. The sheet feeder of claim 8 wherein the second sensor is supported by a sensor support that can be adjusted resulting in the selective positioning of the second sensor relative to the nip.

* * * * *